US012455142B1

(12) United States Patent
Valenti

(10) Patent No.: US 12,455,142 B1
(45) Date of Patent: Oct. 28, 2025

(54) CLAMPING MECHANISM FOR MOUNTING AN ACCESSORY TO A FIREARM BARREL

(71) Applicant: Dominick Valenti, Oldsmar, FL (US)

(72) Inventor: Dominick Valenti, Oldsmar, FL (US)

( * ) Notice: Subject to any disclaimer, the term of this patent is extended or adjusted under 35 U.S.C. 154(b) by 0 days.

(21) Appl. No.: 19/245,815

(22) Filed: Jun. 23, 2025

(51) Int. Cl.
*F41G 11/00* (2006.01)

(52) U.S. Cl.
CPC ..... *F41G 11/004* (2013.01); *F41G 11/003* (2013.01)

(58) Field of Classification Search
CPC ..... F41G 11/00; F41G 11/001; F41G 11/003; F41G 11/004; F41G 1/387
USPC ..... D22/108, 109, 110
See application file for complete search history.

(56) References Cited

U.S. PATENT DOCUMENTS 4,008,536 A * 2/1977 Adams ..... F41G 1/473 42/112
4,143,465 A * 3/1979 White ..... F41G 1/425 42/112
4,383,371 A * 5/1983 Coffey ..... F41G 11/003 42/126
4,835,895 A * 6/1989 Bowen ..... F41G 11/003 42/127
4,890,407 A * 1/1990 Nichols ..... F41G 1/16 D22/110
4,899,479 A * 2/1990 Sanders ..... F41G 1/16 42/112
5,208,407 A * 5/1993 Stover ..... F41G 1/16 42/112
5,784,822 A * 7/1998 Korapaty ..... F41G 11/004 42/124
6,598,331 B1 * 7/2003 Thibodeaux ..... F41G 1/52 42/111
7,240,451 B2 * 7/2007 Blair ..... F41G 11/003 42/124
2002/0104249 A1 * 8/2002 Lin ..... F41G 11/001 42/114

(Continued)

FOREIGN PATENT DOCUMENTS

DE 19720187 A1 * 11/1998 ..... F16B 2/12
EP 0777057 A1 * 6/1997 ..... F16B 2/10

OTHER PUBLICATIONS

Henry All-Weather Picatinny Rail .45-70. "Henry". <https://web.archive.org/web/20240222082933/https://www.henryusa.com/rifles/all-weather-picatinny-rail-45-70/>. Feb. 22, 2024. (Year: 2024).*

(Continued)

*Primary Examiner* — Gabriel J. Klein
(74) *Attorney, Agent, or Firm* — DP IP GROUP; Franco S. De Liguori

(57) ABSTRACT

A clamping mechanism for mounting an accessory, such as a scope, to a firearm barrel includes first and second clamp members with inner planar surfaces configured to engage respective outer surfaces of the barrel so as to distribute clamping forces evenly and minimizing damage to the barrel surface. A dovetail section on one of the clamp members enables attachment of various optics or accessories. The clamp members are secured together using one or more fasteners passing through aligned openings in the clamp members. The clamping mechanism allows non-permanent, stable mounting of accessories without requiring permanent modification to the firearm. The clamping mechanism is particularly configured to be mounted on the barrel of a Henry® brand rifle.

17 Claims, 17 Drawing Sheets

(56) References Cited

U.S. PATENT DOCUMENTS

| | | | | |
|---|---|---|---|---|
| 2004/0000083 | A1* | 1/2004 | Grant, Jr. | F41G 11/003 42/112 |
| 2011/0162251 | A1* | 7/2011 | Houde-Walter | F41G 1/35 42/146 |
| 2017/0059277 | A1* | 3/2017 | Justice | F41G 11/003 |
| 2017/0191801 | A1* | 7/2017 | Tresserras Torre | F41G 11/003 |
| 2019/0113297 | A1* | 4/2019 | Turlakov | F41A 21/487 |
| 2019/0137221 | A1* | 5/2019 | Ross | F41G 11/004 |
| 2022/0196357 | A1* | 6/2022 | Wiedemann | F41C 23/20 |

OTHER PUBLICATIONS

HD Henry Octagon Barrel Picatinny Rail 0 MOA. "Octagon". <https://web.archive.org/web/20240809024118/https://egwguns.com/hd-henry-octagon-barrel-picatinny-rail-0-moa>. Aug. 9, 2024. (Year: 2024).*

* cited by examiner

CLAMPING MECHANISM FOR MOUNTING AN ACCESSORY TO A FIREARM BARREL

BACKGROUND

Technical Field

The present invention relates generally to clamping systems and mechanisms, and more particularly to a clamping mechanism for removably and securely mounting an accessory, such as a scope, on the barrel of a firearm.

Background Information

Users of firearms often desire to attach optical devices, such as scopes, red dot sights, or other accessories, to enhance targeting accuracy, improve visibility, or adapt the firearm for specific applications such as hunting, target shooting, or tactical use. However, conventional scope mounting systems frequently suffer from a number of limitations, particularly when it comes to compatibility with different barrel geometries. Many traditional mounting solutions are designed exclusively for cylindrical or pre-drilled receiver sections and are not easily adaptable to barrels with non-round profiles, such as barrels commonly found on historical or lever-action rifles, including Henry® brand rifles, such as the 1860 style Henry® brand rifle, having facets with slight convex curvature.

In addition to compatibility issues, existing systems often require permanent modifications to the firearm, such as drilling and tapping holes into the barrel or receiver, which can compromise the structural integrity or diminish the collector's value of vintage or historically significant firearms. Other solutions, such as clamping rings or improvised mounts, may fail to provide sufficient stability, resulting in scope misalignment or drift under recoil or vibration. Inadequate surface conformity between the mounting system and the barrel can also lead to uneven clamping forces, which may cause slippage during operation or inflict localized damage, such as scratches, gouges, or deformation, on the firearm's surface.

Furthermore, many existing mounts lack features suited for field use, such as the ability to maintain secure and repeatable attachment under varying conditions, making it difficult for users to adapt their firearms quickly to different shooting environments. These challenges collectively underscore the need for a mounting mechanism that can securely attach to a wide range of barrel profiles without causing damage or requiring permanent alterations, while offering consistent mechanical engagement and the ability to quickly attach or detach optical accessories as needed.

Accordingly, there is a need for an improved clamping mechanism that ensures secure and stable attachment of a scope to a range of firearm barrel shapes while optionally providing a protective interface to prevent marring of the barrel surface.

SUMMARY

The present invention relates to a clamping mechanism for mounting an accessory, such as a scope, to a firearm barrel. The invention provides a robust, stable, and non-invasive solution for securely attaching accessories without the need for permanent modifications to the firearm.

In one embodiment, the clamping mechanism comprises a first clamp member and a second clamp member that cooperate to engage opposing sets of outer surfaces of the firearm barrel. Each clamp member includes a plurality of inner planar surfaces configured for surface-to-surface contact with corresponding planar surfaces of the barrel, thereby promoting even distribution of clamping forces, enhanced stability, and resistance to slippage or rotation during use. The clamp members are removably secured together using a plurality of fasteners extending through aligned openings in the clamp members.

In certain embodiments, the clamp members are L-shaped, with leg portions providing structural support and engagement surfaces for the barrel. One or both clamp members may include a dovetail section integrally formed on an exterior surface to facilitate attachment of an accessory, such as a scope. The dovetail section may include a through-hole or threaded hole for receiving a fastener used to secure the accessory to the clamping mechanism.

The invention may also include protective films, such as polyurethane, PTFE, or rubberized elastomers, disposed on one or more of the planar inner surfaces of the clamp members to prevent abrasion or marring of the barrel's external surfaces.

In some embodiments, the clamping mechanism engages a total of five flat surfaces of the barrel to provide a high degree of mechanical stability. The clamp members may include corresponding threaded through-holes and blind threaded holes to enable secure fastening using removable fasteners. The mechanism may further include features to accommodate manufacturing tolerances, such as a curved outer surface on one clamp member that aligns with but is spaced apart from an inner corner of the opposing clamp member.

Another aspect of the invention provides a quick-release feature, allowing the clamp members to be secured or removed using only the fasteners, without requiring specialized tools.

The clamping mechanism of the present invention is particularly adapted for use with lever-action, tubular magazine rifles, such as various styles of the Henry® brand rifle, such as the 1860 style Henry® brand rifle, provided with a barrel having facets with slight convex curvature.

The invention further encompasses the combination of the clamping mechanism with a firearm having a barrel to which the clamping mechanism is configured to be removably securely mounted.

The foregoing and other features and advantages of the clamping mechanism according to present invention will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein:

In FIGS. 1-34C, similar reference elements denote similar components across all figures.

DETAILED DESCRIPTION OF PREFERRED EMBODIMENTS

Figure 1:
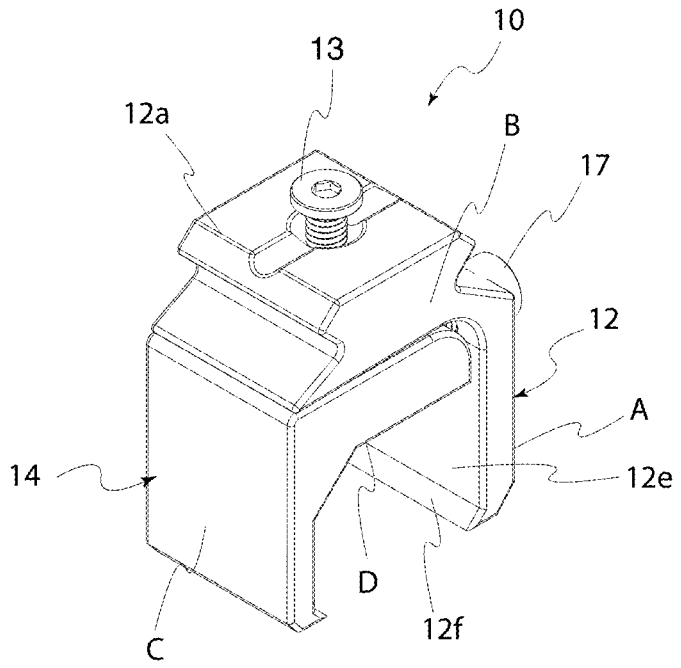
FIG. 1 is a left side perspective view of the clamping mechanism according to an exemplary embodiment of the present invention, showing first and second clamping members partially assembled together with fastening members.

It is to be understood that the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention. Throughout the drawings, the same reference numerals denote the same elements.

The present description may include perspective-based terminology such as "front," "rear," "left," "right," "top," "bottom," as well as similar directional or positional terms. Such language is used solely to facilitate the discussion by illustrating the relative orientation and placement of various components as shown in the accompanying figures. These references are not intended to be limiting and should not be construed as restricting the application or scope of the invention to any particular orientation or configuration.

FIGS. 1-4 illustrate various views of an exemplary embodiment of a clamping mechanism 10 in accordance with the present invention, which includes a first clamping member 12 and a second clamping member 14. FIGS. 5-8 show views corresponding to FIGS. 1-4, respectively, with the omission of fasteners 13, 15, and 17, used to connect the first and second clamp members, for improved clarity of the structural features. FIGS. 9-12 present exploded views of clamping mechanism 10. FIGS. 13-19 depict various views of first clamping member 12, while FIGS. 20-26 show corresponding views of second clamping member 14. FIGS. 28-32 illustrate a configuration 100 in which the clamping mechanism 10 is mounted on a firearm barrel 120.

As described in greater detail below, clamping mechanism 10 is designed to removably secure an accessory, such as a scope, to the exterior surface of a firearm barrel. The first and second clamp members 12 and 14 are configured to be removably joined to one another to form an integrated assembly that can be securely mounted on, and detached from, the barrel without requiring permanent modification to the firearm.

Referring to FIGS. 1-19, and particularly to FIGS. 13-19, the first clamp member 12 has a generally L-shaped configuration, including a first leg portion A and a second leg portion B extending from leg portion A. Leg portion A includes threaded through-holes 12*d* and 12*c* for receiving threaded fasteners 15 and 17, respectively, planar inner surfaces 12*e*, 12*f*, 12*g*, and a curved inner corner surface 12*g*. Leg portion B is integrally formed with a dovetail section 12*a*, which includes a threaded through-hole 12*b* for receiving a threaded fastener 13. The dovetail section 12*a* functions as an interface for attaching a scope or other accessory after the clamping mechanism 10 has been mounted onto the firearm barrel, as described further below. As best shown in FIGS. 13-16, through-hole 12*b* extends from a top surface of dovetail section 12*a* provided on leg portion A and opens to inner surface 12*g*, and through-holes 12*c*, 12*d* extend through an outer surface of leg portion A and opens into inner corner surface 12*h*.

Figure 22:
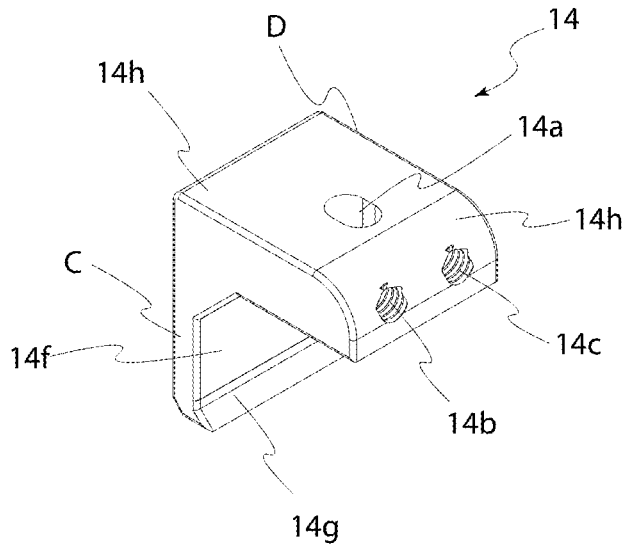
FIG. 22 is another perspective view of the second clamping member in FIG. 20.
Figure 23:
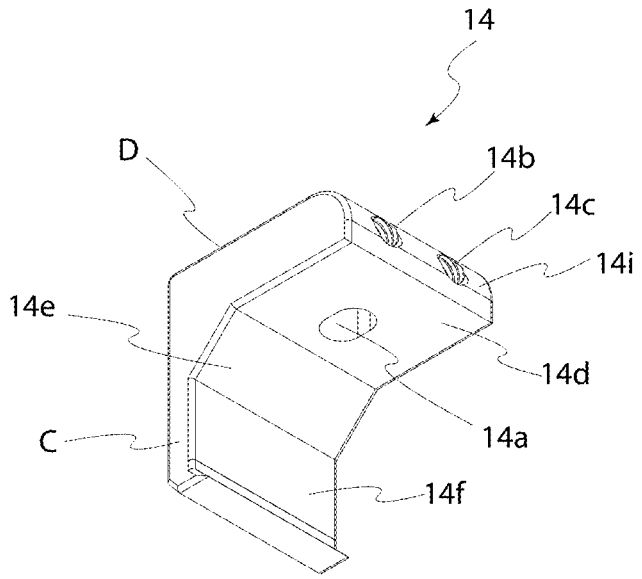
FIG. 23 is another perspective view of the second clamping member in FIG. 20.
Figure 24:
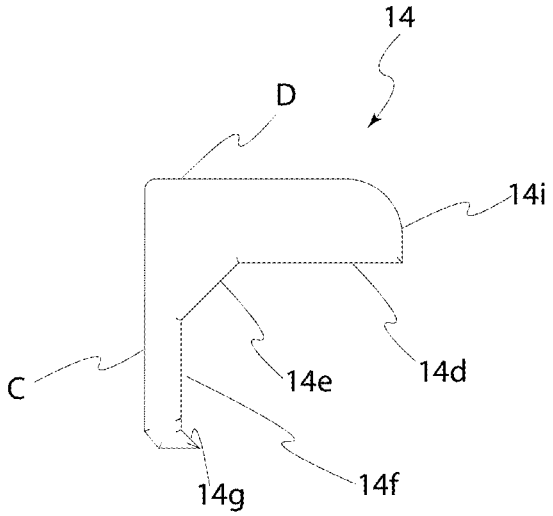
FIG. 24 is a front view of the second clamping member in FIG. 20.
Figure 25:
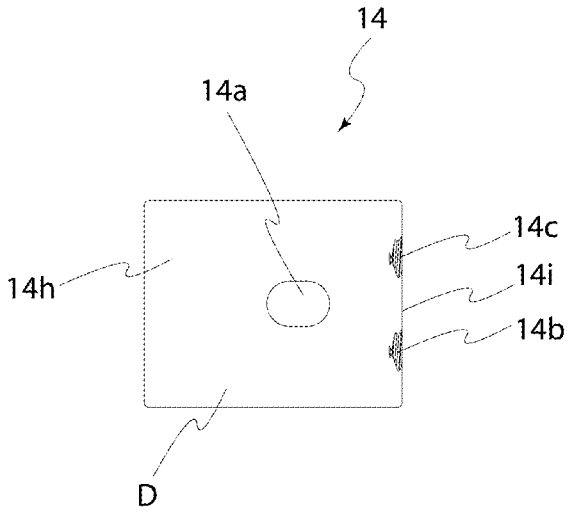
FIG. 25 is a top view of the second clamping member in FIG. 24.
Figure 26:
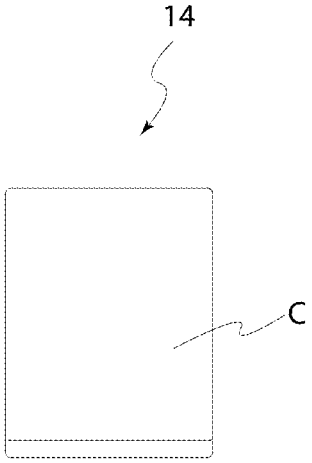
FIG. 26 is a left side view of the second clamping member in FIG. 24.
Figure 32:
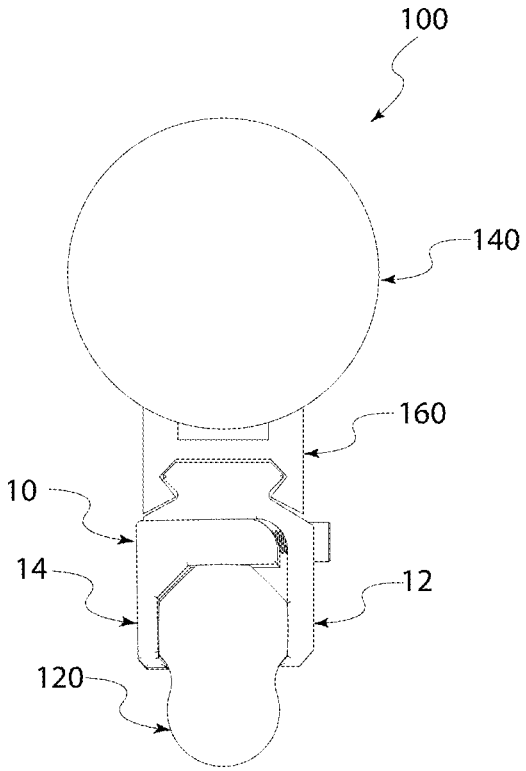
FIG. 32 is a front view of the assembly in FIG. 29.

Referring again to FIGS. 1-19, and particularly to FIGS. 20-26, the second clamp member 14 also has a generally L-shaped configuration, comprising a first leg portion C and a second leg portion D extending from leg portion C. Leg portion C includes planar inner surfaces 14*d*, 14*e*, 14*f*, and 14*g*, as well as a curved outer surface 14*i*. Leg portion D is provided with holes 14*a*, 14*b*, and 14*c* for receiving corresponding threaded fasteners 13, 15, and 17. As shown in FIGS. 22-23, holes 14*b*, 14*c* are blind holes extending into a side surface of leg portion D for receiving respective threaded fasteners 17, 15 when clamp member 12 is connected to clamp member 14. As shown in FIGS. 20-23 and 25, through-hole 14*a* is a smooth through-hole extending from an exterior surface 14*h* of leg portion D and opens to the planar surface 14*d*. Through-hole 14*a* is configured for receiving, but not connecting to, threaded fastener 13 which connects a mounting section 160 of a scope 140 to the dovetail section 12*a* of first clamp member 12 (FIG. 32). Stated otherwise, threaded fastener 13 is permitted to extend into through-hole 14*a* when mounting section 160 is connected to dovetail section 12*a* using threaded fastener 13.

According to a feature of invention, for the first clamp member 12 of the exemplary embodiment inner surface 14*d* is provided on leg portion D, inner surface 14*e* is contiguous with inner surface 14*d* and provided at a region of an intersection between leg portions C and D, inner surface 14*f* is contiguous with inner surface 14*e*, and inner surface 14*g* is contiguous with inner surface 14*f*. Inner surfaces 14*d* and 14*f* are disposed generally perpendicular to one another. For the second clamp member 14 of the exemplary embodiment, inner surface 12*g* is provided on leg portion B, inner surface 12*h* is contiguous with inner surface 12*g* and provided at a region of an intersection between leg portions A and B, inner surface 12*e* is contiguous with inner surface 12*h*, and inner surface 12*f* is contiguous with inner surface 12*e*. Inner surfaces 12*g* and 12*e* are generally perpendicular to one another. Outer surface 14*h* is generally parallel to inner surface 14*d*.

When clamping mechanism 10 is assembled and mounted on barrel 120 as shown in FIG. 32, inner surface 12*g* of first clamp member 12 is generally parallel to outer surface 14*h* and inner surface 14*d* of second clamp member 14, inner surface 12*e* of first clamp member 12 is generally parallel to inner surface 14*f* of second clamp member 14, and inner surface 12*f* of first clamp member 12 is generally parallel to inner surface 14*e* of second clamp member 14.

Figure 2:
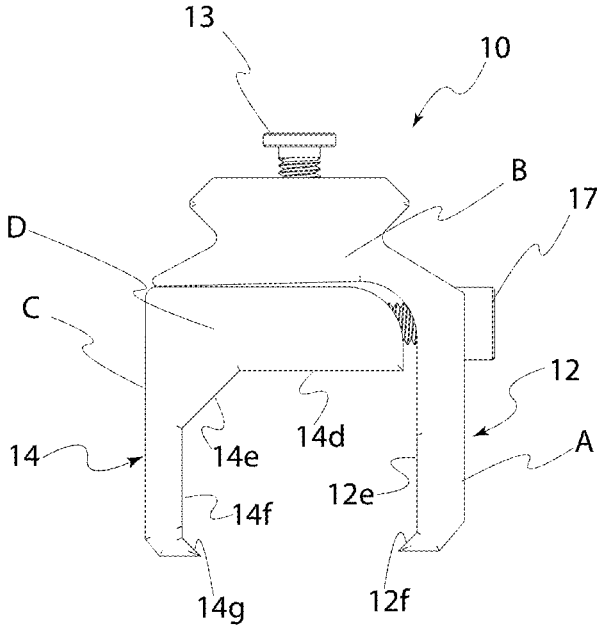
FIG. 2 is a front view of the clamping mechanism in FIG. 1.
Figure 3:
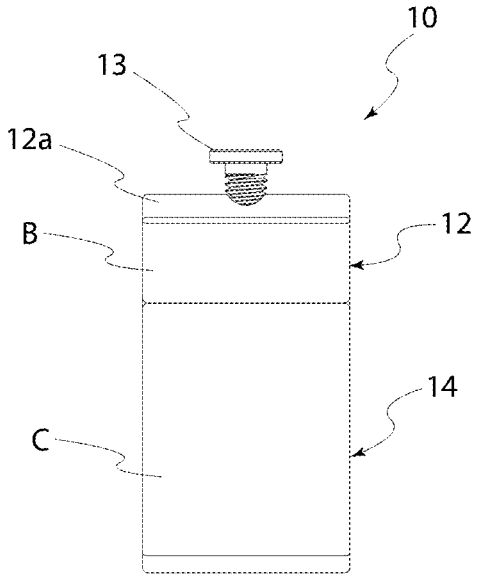
FIG. 3 is a left side view of the clamping mechanism in FIG. 2.
Figure 4:
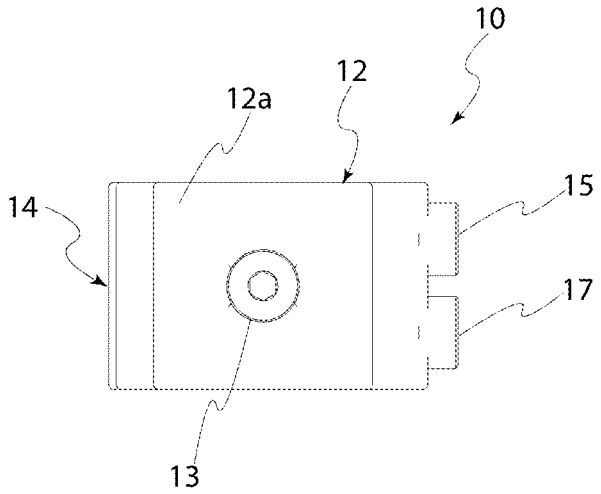
FIG. 4 is a top view of the clamping mechanism in FIG. 2.
Figure 5:
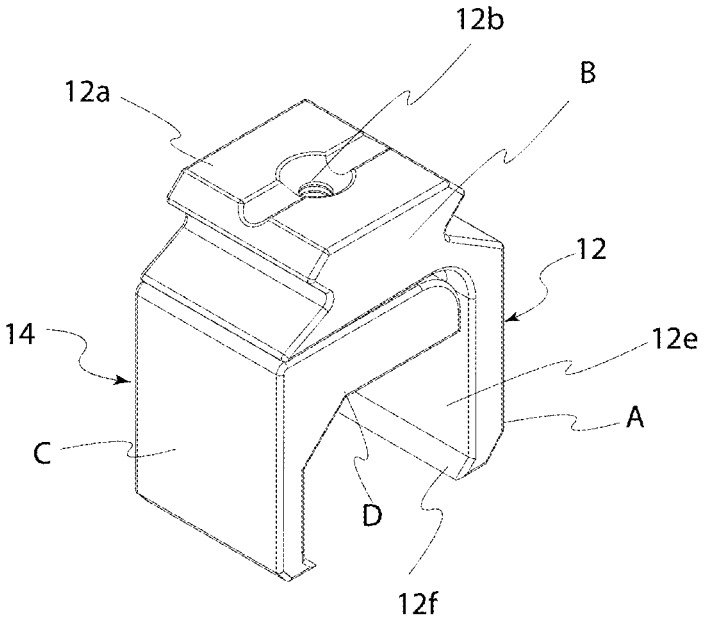
FIG. 5 is a view similar to FIG. 1, but with the fastening members omitted.
Figure 6:
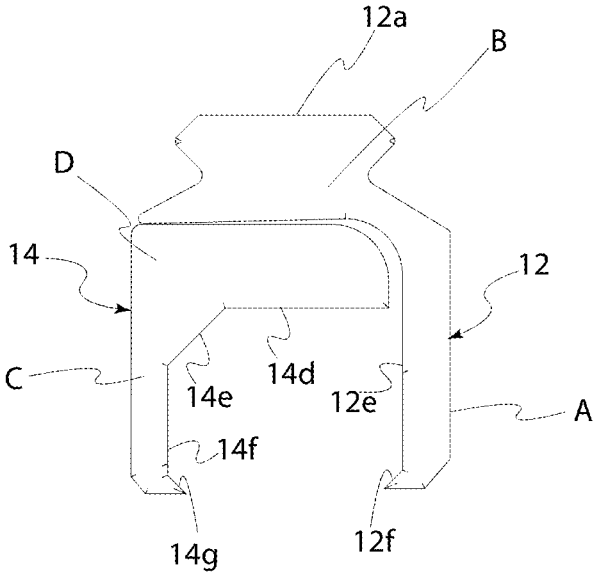
FIG. 6 is a front view of the clamping mechanism in FIG. 5.
Figure 7:
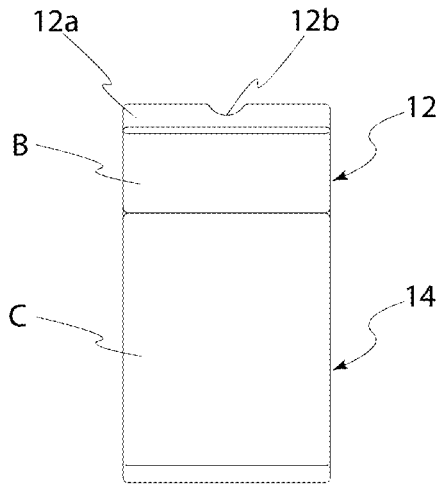
FIG. 7 is a left side view of the clamping mechanism in FIG. 6.
Figure 8:
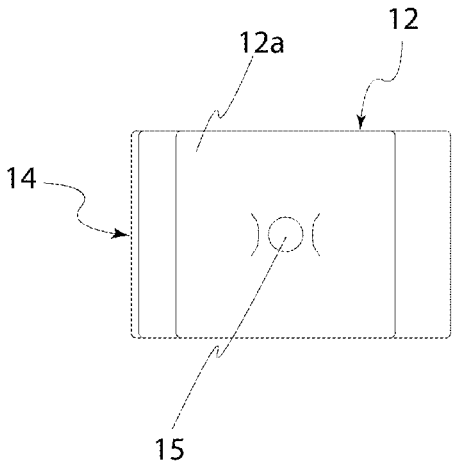
FIG. 8 is a top view of the clamping mechanism in FIG. 6.
Figure 9:
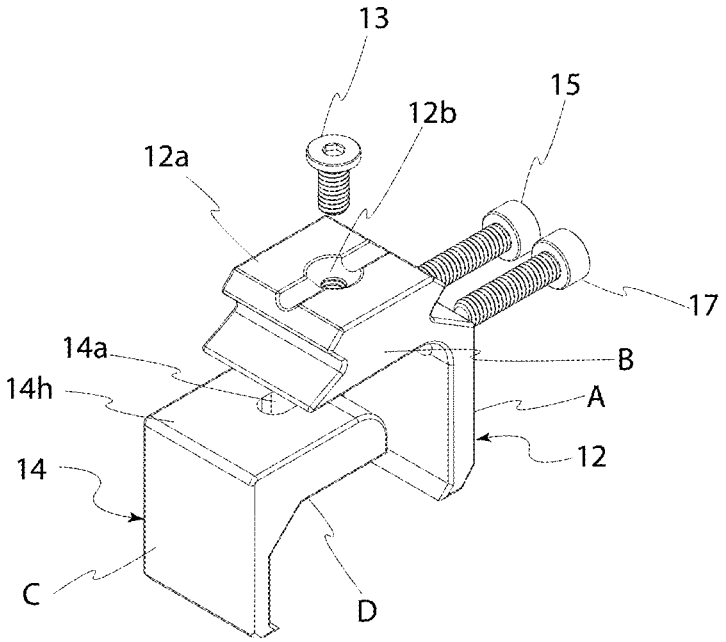
FIG. 9 is an exploded view of the clamping mechanism in FIG. 1.
Figure 10:
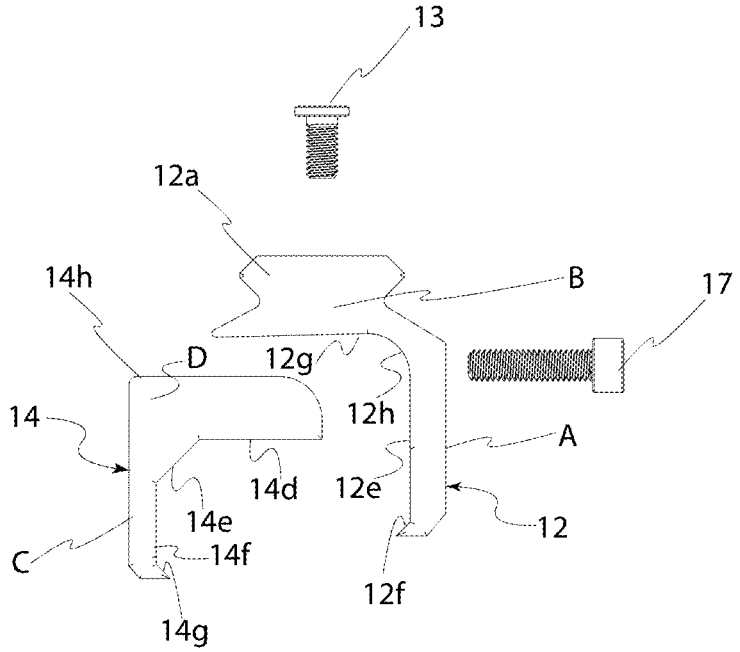
FIG. 10 is a front view of the clamping mechanism in FIG. 9.
Figure 11:
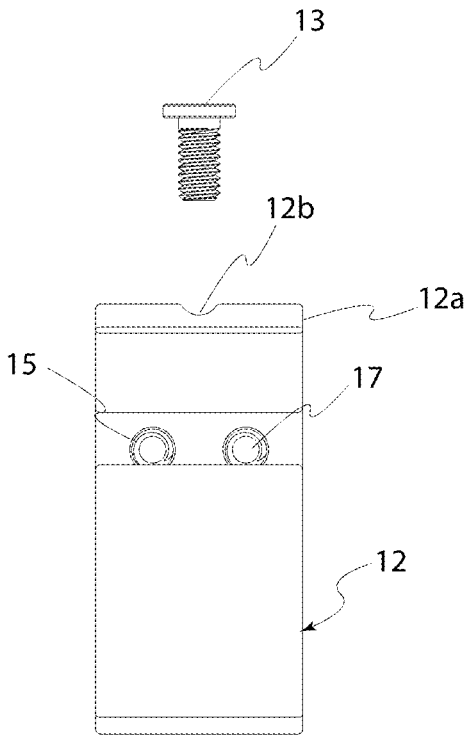
FIG. 11 is a right side view of the clamping mechanism in FIG. 9.
Figure 12:
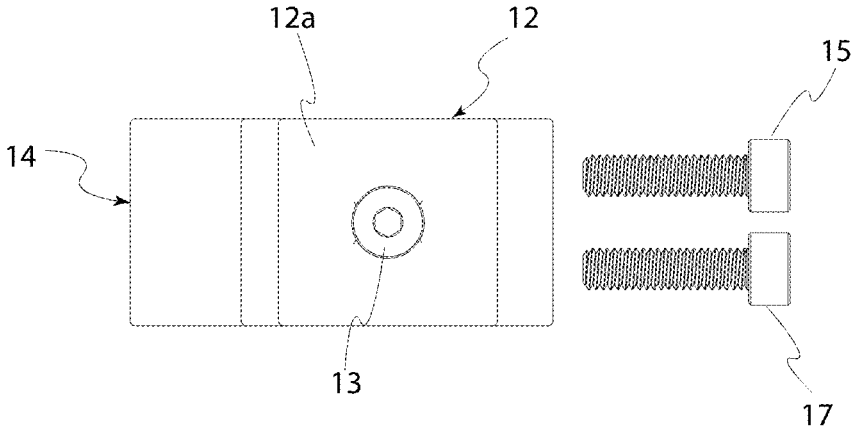
FIG. 12 is a top view of the clamping mechanism in FIG. 9.
Figure 13:
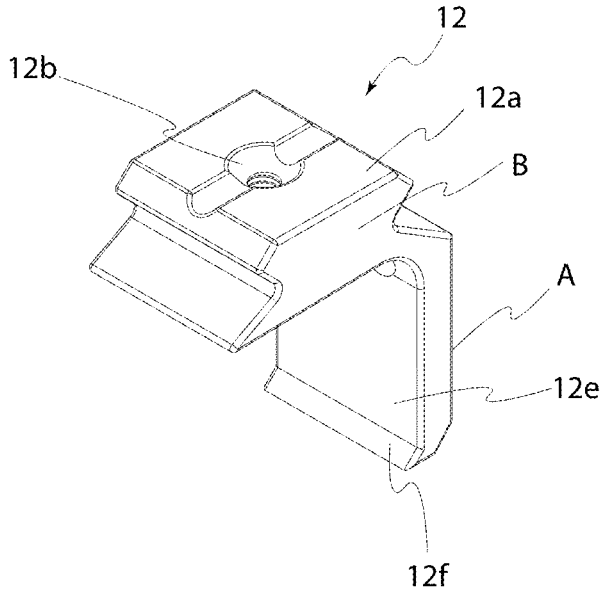
FIG. 13 is a perspective view of a first clamping member of the clamping mechanism according to the exemplary embodiment of the present invention.
Figure 14:
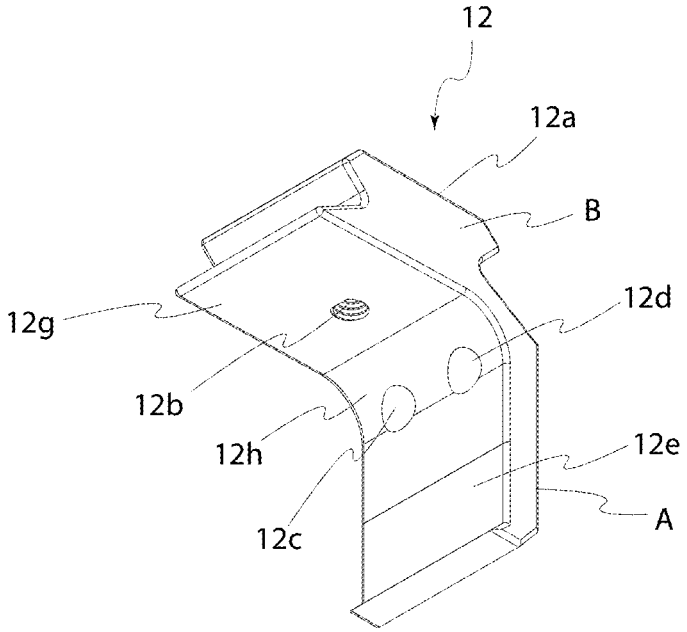
FIG. 14 is another perspective view of the first clamping mechanism in FIG. 13.
Figure 15:
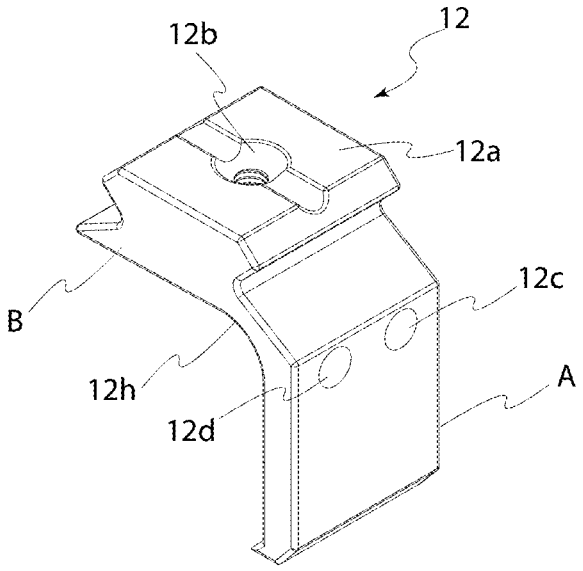
FIG. 15 is another perspective view of the first clamping mechanism in FIG. 13.
Figure 16:
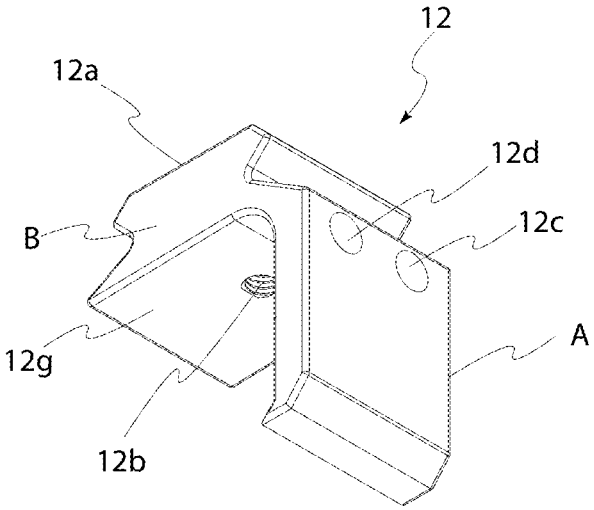
FIG. 16 is another perspective view of the first clamping mechanism in FIG. 13.
Figure 17:
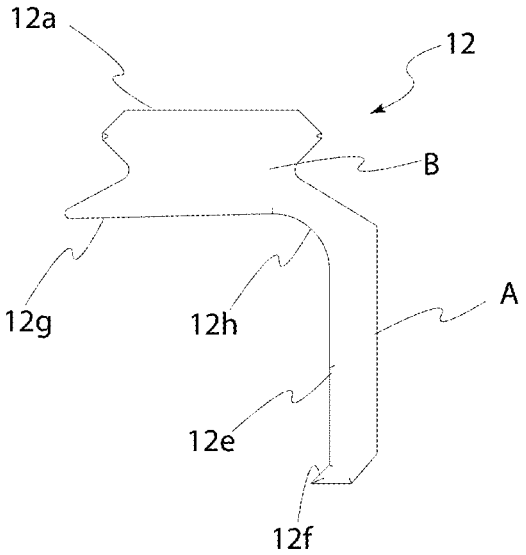
FIG. 17 is a front view of the first clamping mechanism in FIG. 13.
Figure 18:
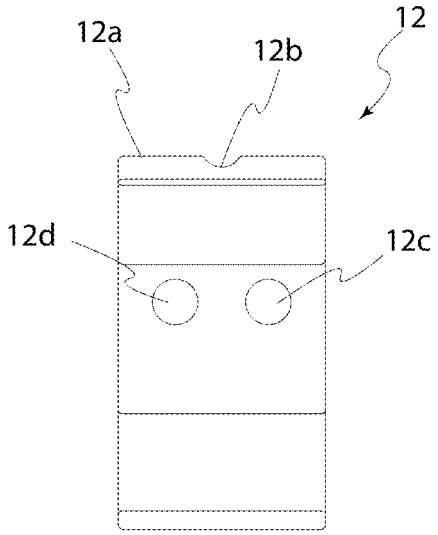
FIG. 18 is a right side view of the first clamping mechanism in FIG. 17.
Figure 19:
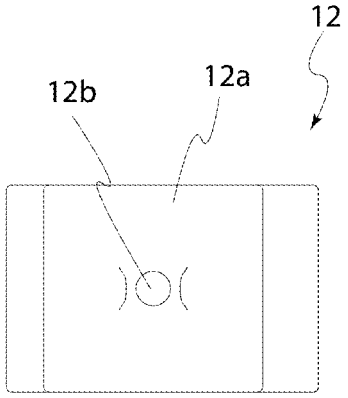
FIG. 19 is a top view of the first clamping mechanism in FIG. 17.
Figure 20:
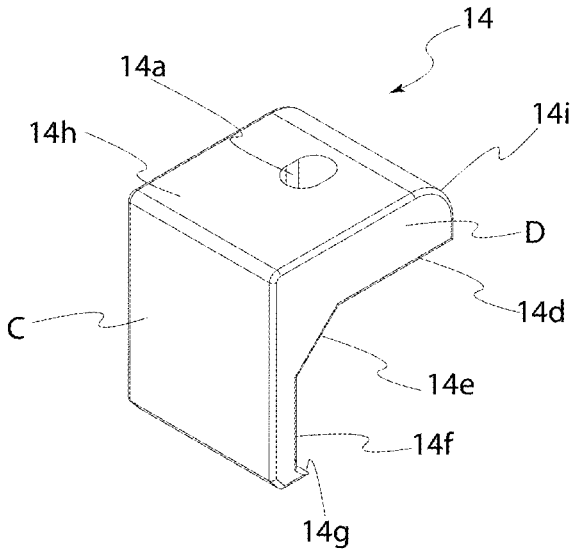
FIG. 20 is a perspective view of the second clamping member of the clamping mechanism according to the exemplary embodiment of the present invention.
Figure 21:
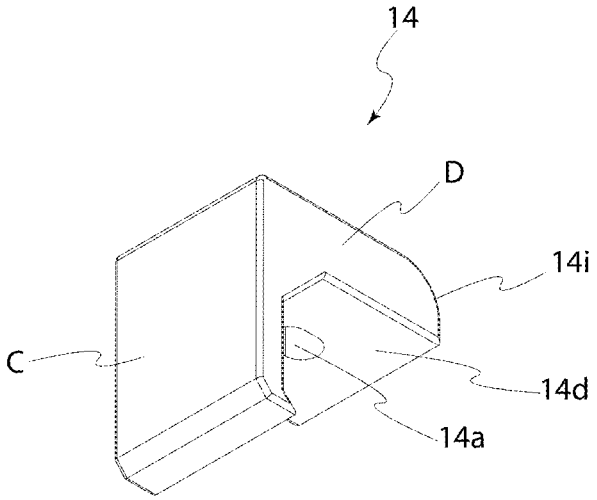
FIG. 21 is another perspective view of the second clamping member in FIG. 20.

In the assembled configuration of clamping mechanism 10 shown in FIG. 2, the first clamp member 12 and the second clamp member 14 are positioned in a generally opposing relationship, with their respective legs extending downward and configured to clamp around the outer surface the firearm barrel, as shown in FIG. 32.

Leg D of the second clamp member 14 is nested underneath leg B of the first clamp member 12. This nesting arrangement provides lateral stability and allows the fastener 13 to draw the clamp members toward one another during tightening, ensuring a secure attachment to the barrel.

Leg A of the first clamp member 12 and leg C of the second clamp member 14 each include respective inward-facing tapered surfaces 12*f* and 14*g*. These tapered surfaces are oriented toward one another and are configured to simultaneously engage and clamp opposing side surfaces of the barrel. The angled nature of the tapered surfaces promotes secure contact with the generally curved or flat sides of the barrel, enhancing grip while minimizing potential damage to the barrel surface. This configuration ensures a balanced and secure clamping force around the barrel, with surfaces 12*e*, 14*e*, and 14*f* providing additional surface engagement to resist rotation or shifting of the clamping mechanism during use.

Thus, for the clamping mechanism 10 of the present invention, the inner surfaces 12*e*, 12*f* of the first clamp member 12 and inner surfaces 14*d*, 14*e*, 14*f*, 14*g* of the second clamp member 14 are configured to removably securely engage the outer surface of a firearm barrel 120, as illustrated in FIGS. 28-32. This configuration promotes enhanced stability of the mounted accessory and facilitates even distribution of clamping forces along the contact surfaces.

According to a feature of the present invention, the clamping mechanism 10 is particularly adapted for use with barrel profiles commonly found on Henry® brand rifles, such as the barrel of the 1860 style Henry® brand rifle which characteristically features facets with a slight convex curvature (i.e., gently rounded flat surfaces). On a barrel like the 1860 style Henry® brand rifle with slightly convex facets, the planar surfaces of clamp mechanism 10 are configured to engage each facet with near-full contact due to the gentle curvature. The flat-on-convex interface results in a stable, high-friction connection, particularly when clamping force is applied. The faceted geometry ensures precise axial alignment, while the curvature is shallow enough that full-face engagement is functionally approximated.

In addition to compatibility with Henry® brand rifles, the clamping mechanism of the present invention is also designed to accommodate similarly profiled barrels found on other lever-action and historical reproduction rifles, such as the Winchester®, Marlin®, Rossi®, and Uberti™ brand rifles. Many of these rifles share design elements derived from late 19th-century firearms, including octagonal or partially faceted barrels, which require a clamping interface tailored to flat or polygonal surfaces rather than conventional round profiles. The clamping mechanism of the present invention may also be adapted or dimensioned to interface with modern interpretations of these rifles, ensuring secure and repeatable alignment without damaging the barrel finish or affecting sighting systems.

By accounting for the geometric nuances of both vintage-inspired and contemporary lever-action rifles across multiple manufacturers, the clamping mechanism 10 of the present invention provides a versatile and reliable platform for mounting accessories, optics, or other components in a manner that preserves both the function and aesthetic integrity of the firearm.

As shown in FIGS. 1-4, first clamp member 12 and second clamp member 14 are connectable to one another to form a unitary clamping mechanism 10 with a generally rectangular configuration when viewed in profile. The L-shaped profiles of members 12 and 14 are oriented such that inner planar surface 12*g* of first clamp member 12 is aligned for engagement with outer surface 14*h* of second clamp member 14, and inner corner surface 12*h* of first clamp member 12 is aligned with, but does not contact, curved outer surface 14*i* of second clamp member 14. In the assembled configuration, these surfaces contribute to the structural interfit between the two members, as shown in FIGS. 1-2.

FIGS. 1-4 illustrate a preliminary positioning of first clamp member 12 and second clamp member 14 relative to one another, prior to tightening fasteners 13, 15, and 17. In this preliminary position, clamping mechanism 10 is loosely assembled and can be placed over firearm barrel 120, as shown in FIGS. 28-32. Once in position, threaded fasteners 13, 15, and 17 are tightened through aligned through-holes 12*b*/14*a*, 12*c*/14*b*, and 12*d*/14*c*, respectively, to securely connect clamp members 12 and 14 together and fix clamping mechanism 10 onto barrel 120. Alternatively, clamp members 12 and 14 may first be separately positioned relative to barrel 120, with one member placed on one side of the barrel and the other placed on the opposite side. Thereafter, the members may be joined and fastened together using threaded fasteners 13, 15, and 17.

When clamping mechanism 10 is fully mounted (i.e., removably secured) to firearm barrel 120 as shown in FIG. 32, surface 12*g* of first clamp member 12 is in contact with outer surface 14*h* of second clamp member 14 to enhance mechanical interlock. However, curved surface 14*i* of second clamp member 14 is aligned with but spaced apart from inner surface 12*h* of first clamp member 12, such that there is no contact between these regions when the clamping mechanism 10 is removably secured to barrel 120.

As further illustrated in FIG. 32, when clamping mechanism 10 is fully mounted on barrel 120, surfaces 12*e* and 12*f* of first clamp member 12 engage corresponding outer surfaces of barrel 120, and surfaces 14*d*, 14*f*, and 14*g* of second clamp member 14 engage additional corresponding outer surfaces of the barrel 120. Planar surface 14*e*, while aligned with an outer surface of barrel 120, is spaced apart and does not contact the barrel outer surface, allowing for tolerance accommodation and clamping flexibility. Accordingly, a total of five planar surfaces of clamping mechanism 10, two from first clamp member 12 and three from second clamp member 14, are configured to contact corresponding outer surfaces of barrel 120 when clamping mechanism is fully mounted on barrel 120, providing distributed clamping pressure, increased frictional resistance to movement, and reduced risk of slippage during firearm operation. This configuration also contributes to the repeatability and reliability of mounting accessories, such as scopes, on the firearm barrel 120 with consistent alignment and stability, particularly when the clamp mechanism 10 is removed and remounted relative to the firearm barrel.

Figure 31:
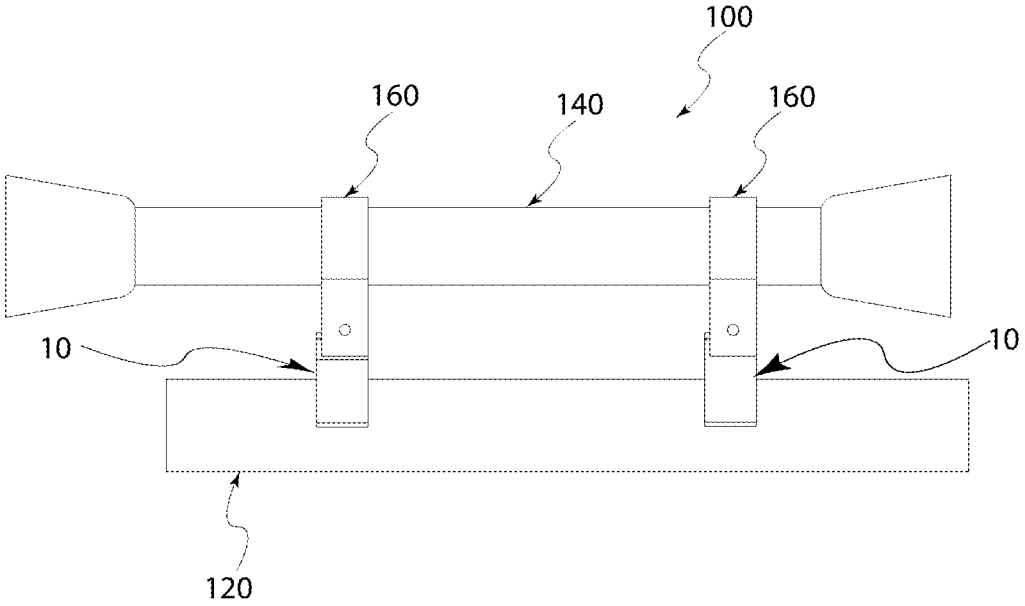
FIG. 31 is a side view of the assembly in FIG. 29.

This precise alignment and surface engagement between the clamp members 12, 14 and the surfaces of barrel 120, such as shown in FIG. 31, for example, provides a contact interface ensuring that clamping mechanism 10 remains securely in place during dynamic conditions such as firearm recoil, ambient vibration, or handling. Furthermore, this contact interface maximizes frictional engagement, improving grip and resisting displacement or loosening over time. In addition to mechanical stability, the design permits quick removal or repositioning of the clamping mechanism without requiring permanent modification to the firearm or causing damage to the barrel, thereby enhancing overall versatility and ease of use for a wide range of users, including hunters, sport shooters, and tactical professionals.

A further feature of clamping mechanism 10 is its quick-release capability, which allows the user to rapidly install or remove the mechanism without the need for specialized tools or permanent firearm modification. In the preliminary positioning shown in FIGS. 1-4, clamp members 12 and 14 may be placed over or around the barrel 120 and secured using threaded fasteners 13, 15, and 17. This tool-assisted but non-permanent fastening enables users to attach or detach accessories such as scopes in the field quickly and reliably. The quick-release feature supports efficient maintenance, transportation, or reconfiguration of the firearm, making clamping mechanism 10 especially useful for users who require flexibility, such as hunters switching optics, sport shooters adjusting setups between competitions, or tactical professionals needing to adapt to changing mission requirements.

As another feature of the present invention, requiring only fasteners 15 and 17 to removably and securely connect the first clamp member 12 to the second clamp member 14 provides significant functional and ergonomic benefits. Notably, fasteners 15 and 17 are easily accessible from the side of the clamping mechanism 10 when it is mounted on firearm barrel 120. This is because the corresponding threaded through-holes 14*b* and 14*c* of the second clamp member 14 are formed in and extend into a side surface of leg portion D, as illustrated and described above.

The side-access configuration for fasteners 15, 17 offers several key advantages. Side access to fasteners 15 and 17 allows a user to install or remove the clamping mechanism without needing to manipulate tools in confined or obstructed spaces, particularly underneath or behind the firearm barrel. This simplifies field assembly and disassembly, especially when the firearm is equipped with other mounted components. Since the fasteners are accessible from the side, a user can more comfortably align and operate standard tools (e.g., Allen keys, screwdrivers) without having to contort around the firearm or remove adjacent accessories. This streamlines maintenance and adjustment procedures. Furthermore, because the fasteners are not accessed from below or the inner side of the clamp (i.e., the barrel-facing side), there is a minimal risk of damaging or scratching the barrel during installation or removal. This design consideration is particularly important for preserving the integrity and appearance of the firearm's finish.

Moreover, by needing only two fasteners 15, 17 to achieve a secure, removable connection between the clamp members, the mechanism avoids unnecessary complexity and weight. This makes the system more reliable and cost-effective while maintaining secure clamping performance. In sum, the ability to secure clamp members 12 and 14 using only two side-accessible fasteners enhances the usability, safety, and serviceability of the clamping mechanism 10 while maintaining a strong and stable interface with the firearm barrel 120.

First clamp member 12 and second clamp member 14 of clamping mechanism 10 may be constructed from a variety of durable, high-performance materials. A preferred material is anodized aluminum, which offers an optimal balance of strength, corrosion resistance, and lightweight characteristics suitable for firearm-mounted accessories. Other suitable materials include stainless steel for enhanced structural rigidity, polymer composites for reduced weight and cost, or titanium alloys for premium strength-to-weight performance. Material selection may be adjusted depending on intended use conditions, weight constraints, manufacturing considerations, or end-user preferences.

Figure 27:
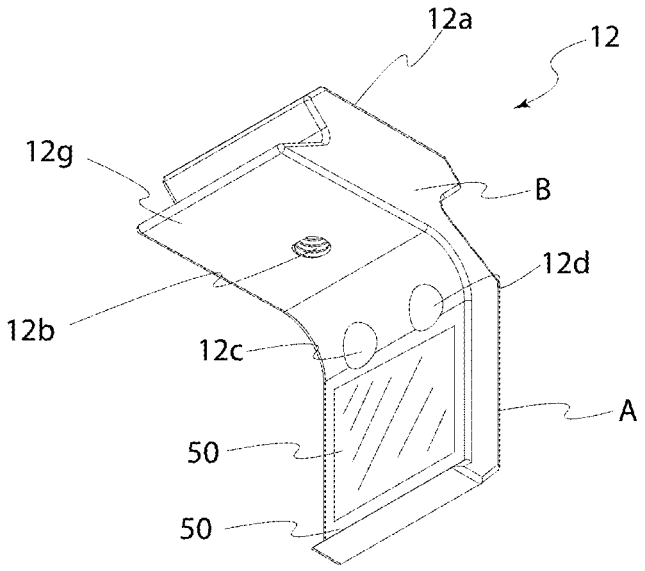
FIG. 27 is a perspective view similar to FIG. 14, but illustrating another embodiment of the first clamping member.
Figure 28:
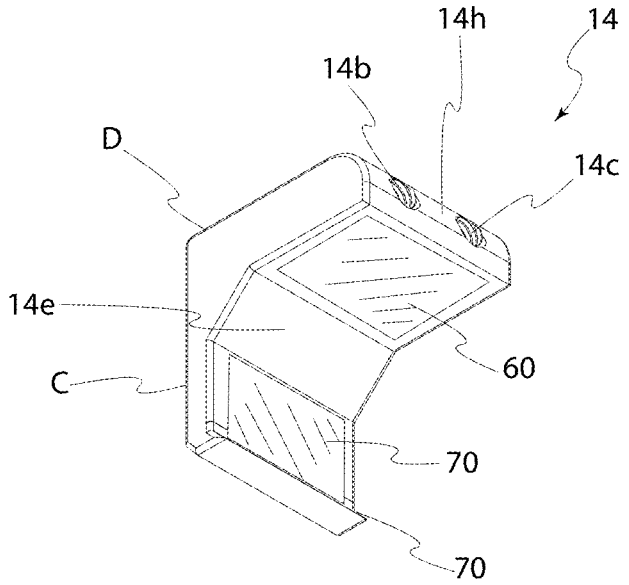
FIG. 28 is a perspective view similar to FIG. 23, but illustrating another embodiment of the second clamping member.
Figure 29:
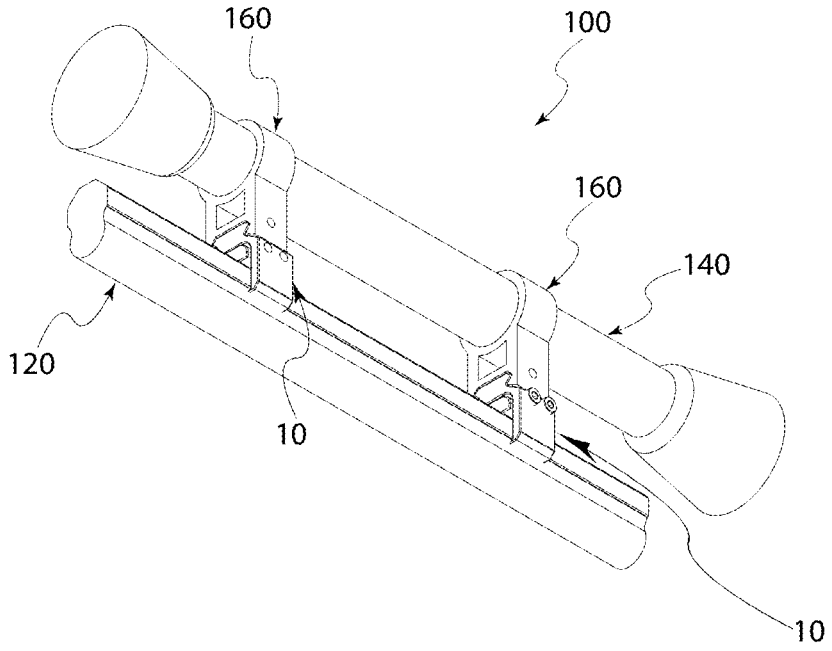
FIG. 29 is a perspective view of the clamping mechanism of the present invention in an assembled state positioned on a firearm barrel for mounting a scope to bun barrel.
Figure 30:
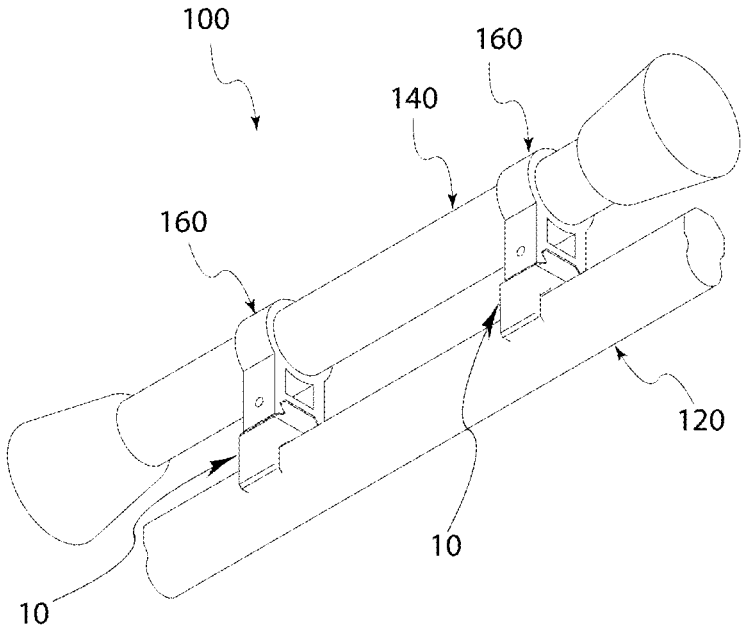
FIG. 30 is another perspective view of the assembly in FIG. 29.

Referring to FIGS. 27-28, in an exemplary embodiment protective films are provided on selected inner surfaces of clamp members 12 and 14 to further safeguard the corresponding outer surfaces of barrel 120 during use. Specifically, protective films 50 are applied to planar inner surfaces 12*e* and 12*f* of first clamp member 12, protective film 60 is applied to planar surface 14*d* of second clamp member 14, and protective films 70 are applied to planar surfaces 14*f* and 14*g* of second clamp member 14. These protective films, which are disposed between the inner surfaces of the clamp members and the corresponding outer surfaces of the barrel when the clamping mechanism is mounted on the barrel, serve to reduce the risk of scratching, abrasion, or cosmetic damage to the barrel's exterior surface that may otherwise result from direct metal-to-metal contact when clamping mechanism 10 is mounted and secured onto barrel 120.

As described above, the clamping mechanism is particularly configured to be mounted on outer surfaces of a firearm barrel provided with slight convex curvature (i.e., gently rounded flat surfaces), such as the 1860 style Henry® brand rifle. The provision of the protective films further functions to increase the contact area between the inner surfaces of the clamp members and the corresponding outer surfaces of the barrel.

The protective films may be made of various soft or semi-soft materials that provide a cushioning or non-marring interface between the inner surfaces of the clamp members and the firearm barrel, as well as assisting to increase the contact areas as described above. Suitable materials include polyurethane, polyethylene, polytetrafluoroethylene (PTFE), rubberized elastomers, felt-based composites, or pressure-sensitive adhesive-backed polymers. These films may be selected based on desired properties such as resistance to heat, oils, solvents, or friction, and may be configured in thicknesses appropriate to balance protection with maintenance of tight mechanical engagement between the clamping mechanism and barrel 120.

The protective films can be pre-cut and applied to the selected clamp surfaces using pressure-sensitive adhesives or bonded using heat-activated or solvent-based adhesion techniques. Alternatively, protective coatings may be applied as liquid-applied films, such as dip coatings, sprays, or brush-on polymer layers, that cure to form a thin, durable protective layer conforming to the surface geometry of the clamp members. For removable or user-replaceable options, adhesive-backed film pads or peel-and-stick liners may be provided to allow end users to replace the protective layers as needed.

In addition to or in place of protective films, other means of protecting the outer surface of barrel 120 may be employed. For example, clamp members 12 and 14 may be lined with replaceable or embedded inserts made of non-marring materials such as silicone rubber or molded polymer pads. Alternatively, the clamp members themselves may be fabricated or coated with a surface finish engineered to reduce abrasion, such as anodizing with a smooth finish, ceramic coatings, or low-friction polymer coatings applied to the barrel-contacting surfaces. These alternatives may offer enhanced durability or integration into the clamping system depending on intended use cases and manufacturing preferences.

FIGS. 27-32 illustrate an exemplary embodiment in which the clamping mechanism 10 is removably secured to the outer surface of a barrel 120 of a firearm. In the illustrated configuration, two clamping mechanisms 10 are shown removably attached to the barrel 120, each operatively coupled to a corresponding mounting section 160 of a scope 140, such as a rifle scope. This arrangement enables the secure yet removable attachment of the scope 140 directly to the barrel 120, thereby eliminating the need for traditional receiver- or rail-based mounting systems.

It will be appreciated, however, that the exemplary embodiments of the present invention are not limited to the use of two clamping mechanisms. Depending on the size, weight, and geometry of the accessory to be mounted, one or more clamping mechanisms 10 may be employed to ensure proper alignment and stability. The modular nature of the clamping mechanism allows it to accommodate a wide range of firearm accessories, including, but not limited to, optical sights, laser modules, flashlights, bipods, or other tactical or utility components, based on the type of firearm and the specific preferences of the user. This flexibility makes the clamping mechanism of the present invention particularly advantageous for customized firearm setups where barrel-mounted accessory placement is desired without permanent modification to the firearm.

In an exemplary embodiment suitable for mounting the clamping mechanism 10 onto the outer surfaces of a Henry® brand rifle, such as the 1860 style Henry® brand rifle, the first clamp member 12 and second clamp member 14 are dimensioned to form a secure and stable interface around the barrel, while also supporting a dovetail section 12*a* sized to accommodate a standard scope base or optic mount.

Figure 33A:
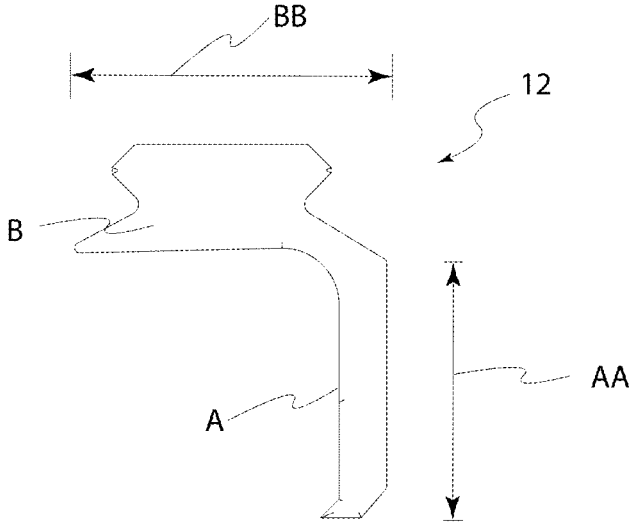
FIG. 33A-33B show various dimensional representations for the first clamping member.
Figure 33B:
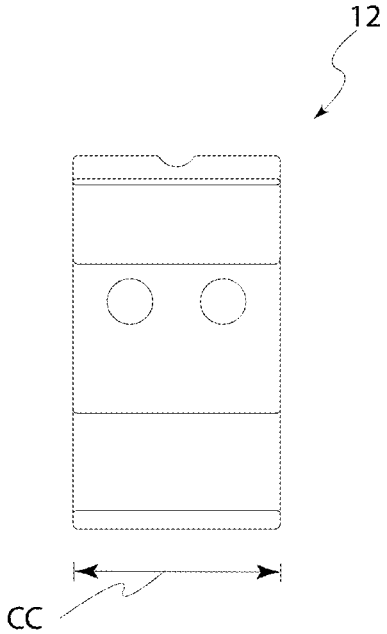
Figure 34A:
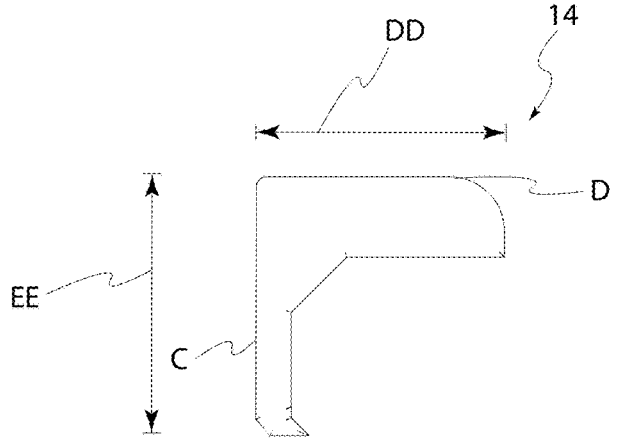
FIGS. 34A-34C show various dimensional representations for the second clamping member.
Figure 34B:
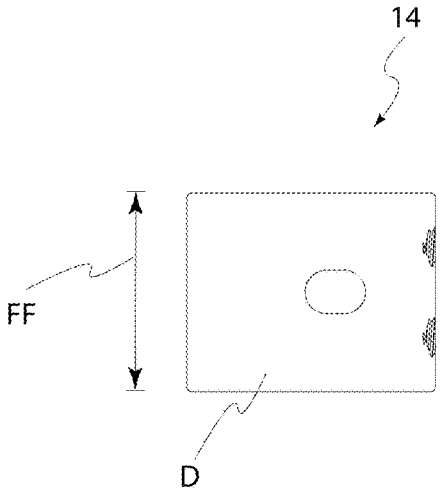
Figure 34C:
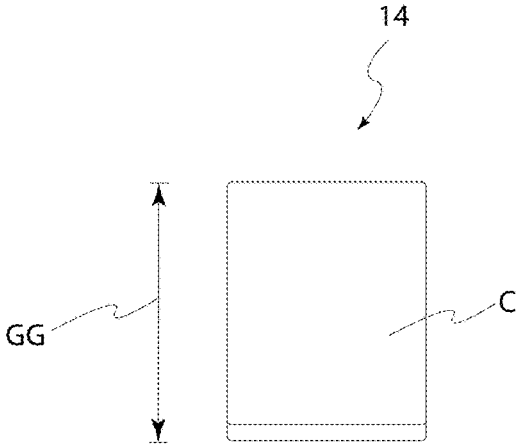

Referring to FIGS. 33A-33B, the first clamp member 12 includes the following exemplary dimensions:

Dimension AA: about 1.0 inch
Dimension BB: about 1.2 inches
Dimension CC: about 0.8 inch Referring to FIGS. 34A-34C, the second clamp member 14 includes the following exemplary dimensions:

Dimension DD: about 1.0 inch
Dimension EE: about 1.0 inch
Dimension FF: about 0.8 inch
Dimension GG: about 1.0 inch The foregoing dimensions AA, BB, CC, DD, EE, FF, and GG are considered critical for establishing a secure and stable interface between the clamping mechanism 10 and the barrel of a Henry® brand rifle, such as the 1860 style Henry® brand rifle.

In alternative embodiments, the clamping mechanism may be used to mount accessories other than a scope to a firearm barrel. Such accessories may include, but are not limited to, laser sights, flashlights, infrared illuminators, range finders, video cameras, or accessory rail adapters (e.g., Picatinny or Weaver rails) for further modular attachment. For these applications, the top of the first clamp member 12 need not be limited to a dovetail section. Instead, the top surface of first clamp member 12 may be configured with an alternative attachment interface such as an integrated Picatinny rail, a flat mounting platform with threaded inserts, or a quick-detach socket for modular accessory mounting systems. These configurations enable the clamping mechanism to serve as a universal mounting platform, offering flexibility to support various field, tactical, or recreational applications while maintaining the same underlying clamping structure for secure and non-permanent attachment to the firearm barrel.

The clamping mechanism 10 of the present invention offers a robust solution for removably securely mounting accessories such as scopes to firearm barrels, particularly Henry® brand rifles, such as the 1860 style Henry® brand rifle. The engagement between the clamping mechanism and firearm barrel provides stable, repeatable alignment without the need for drilling, tapping, or otherwise modifying the firearm. This makes it especially well-suited for historic or collectible firearms where preservation of the original structure and finish is paramount. The modular two-part configuration of the clamping mechanism 10 also allows for simple installation and removal, supporting rapid field adaptation for various shooting scenarios.

In addition to its mechanical reliability, the clamping mechanism 10 is designed for versatility, adaptability, and user convenience. It accommodates different barrel geometries through modifiable inner surfaces, and it can be enhanced with protective films or coatings to further safeguard the firearm's finish as well as increase the contact area between the inner surfaces of the clamp members and the corresponding outer surfaces of the barrel. The use of lightweight, durable construction materials, such as aluminum alloys, for the clamping members of the clamping mechanism 10 enable long-term performance without significantly increasing firearm weight. Whether for hunters, sport shooters, or collectors, the clamping mechanism 10 of the present invention delivers a practical, durable, and firearm-friendly platform for precision optic mounting.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A clamping mechanism for removably securing an accessory to a firearm barrel, comprising:

a first clamp member having a generally L-shaped configuration defined by a first leg portion and a second leg portion extending from the first leg portion, the first clamp member including a first set of planar inner surfaces configured to engage corresponding outer surfaces of the firearm barrel, and a first exterior side surface comprising at least one threaded through-hole; and a second clamp member having a generally L-shaped configuration defined by a first leg portion and a second leg portion extending from the second leg portion, the second clamp member including a second set of planar inner surfaces configured to engage additional corresponding outer surfaces of the firearm barrel, an exterior side surface of the second leg portion comprising at least one blind threaded hole configured to be aligned with the at least one threaded through-hole of the first clamp member;

wherein the first and second clamp members are removably and securely connected together using a removable fastener extending through the threaded through-hole in the first clamp member and into the blind threaded hole in the second clamp member;

wherein the first set of planar inner surfaces and the second set of planar inner surfaces are collectively configured for engagement with corresponding outer surfaces of the firearm barrel, thereby distributing clamping forces and resisting rotation or slippage of the clamping mechanism during use;

wherein the first and second clamp members each includes a tapered inner planar surface configured to engage and clamp opposing outer surfaces of the firearm barrel; and further comprising a quick-release capability whereby the clamp members are securable and removable using only said fastener, without requiring specialized tools; and wherein the exterior side surface of the second leg portion of the second clamp member comprises a curved outer surface configured to be aligned with, but spaced apart from, an inner curved corner surface formed at an intersection of the first and second leg portions of the first clamp member to accommodate tolerance when the clamping mechanism is mounted on the firearm barrel for removably securing an accessory to the firearm barrel.

2. The clamping mechanism of claim 1, wherein the at least one threaded through-hole of the first clamp member is formed on and extend into an exterior side surface of the first leg portion of the first clamp member, and the at least one blind threaded hole of the second clamp member is formed on and extend into an exterior side surface of the second leg portion of the second clamp member.

3. The clamping mechanism of claim 1, wherein the first clamp member further includes a dovetail section integrally formed with the second leg portion, the dovetail section configured to interface with a scope or other accessory mount configured to be mounted to the firearm barrel using the clamping mechanism; and wherein the dovetail section includes a threaded hole extending from a top surface of the first clamp member into an interior surface of the second leg portion of the first clamp member for receiving a fastener used to attach the accessory.

4. The clamping mechanism of claim 1, wherein the first clamp member includes a dovetail section for attaching an accessory.

5. The clamping mechanism of claim 1, wherein at least one planar inner surface of the first and second sets of planar inner surfaces of the first and second clamp members includes a protective film to prevent abrasion of the barrel surface.

6. The clamping mechanism of claim 5, wherein the protective film comprises polyurethane, polytetrafluoroethylene (PTFE), or a rubberized elastomer.

7. The clamping mechanism of claim 1, wherein each of the planar inner surfaces of the first and second sets of planar inner surfaces of the first and second clamp members is provided with a protective film to prevent abrasion of the outer surface of the firearm barrel with which it is configured to engage.

8. The clamping mechanism of claim 7, wherein the protective film comprises polyurethane, polytetrafluoroethylene (PTFE), or a rubberized elastomer.

9. In combination:

a rifle having a barrel formed with a plurality of outer surfaces each having a convex curvature; and the clamping mechanism of claim 1, wherein the clamping mechanism of claim 1 is configured to be removably secured to a barrel of the rifle such that first and second set of planar inner surfaces of first and second clamp members are disposed in contact with respective outer surfaces of the barrel.

10. The combination of claim 9, wherein the rifle comprises a lever-action, tubular magazine rifle.

11. A clamping mechanism for removably securing an accessory to a firearm barrel, the clamping mechanism comprising:

a first clamp member including a first leg portion and a second leg portion extending from the first leg portion, the first clamp member having a first set of planar inner surfaces configured to engage corresponding outer surfaces of the firearm barrel and a first exterior side surface comprising at least one threaded through-hole;

a second clamp member including a first leg portion and a second leg portion extending from the first leg portion, the second clamp member having a second set of planar inner surfaces configured to engage additional corresponding outer surfaces of the firearm barrel and an exterior side surface of the second leg portion comprising at least one blind threaded hole configured to be aligned with the at least one threaded through-hole of the first clamp member; and a removable fastener extending through the threaded through-hole in the first clamp member and into the blind threaded hole in the second clamp member, the removable fastener providing a quick-release capability whereby the first and second clamp members are securable and removable without requiring specialized tools;

wherein the first set of planar inner surfaces and the second set of planar inner surfaces are collectively configured for engagement with corresponding outer surfaces of the firearm barrel, thereby distributing clamping forces and resisting rotation or slippage of the clamping mechanism during use;

wherein the first and second clamp members each include a tapered inner planar surface configured to engage and clamp opposing outer surfaces of the firearm barrel; and wherein the exterior side surface of the second leg portion of the second clamp member comprises a curved outer surface configured to be aligned with, but spaced apart from, an inner curved corner surface formed at an intersection of the first and second leg portions of the first clamp member to accommodate tolerance when the clamping mechanism is mounted on the firearm barrel for removably securing an accessory to the firearm barrel.

12. The clamping mechanism of claim 11, wherein the at least one threaded through-hole of the first clamp member is formed on and extend into an exterior side surface of the first leg portion of the first clamp member, and the at least one blind threaded hole of the second clamp member is formed on and extend into an exterior side surface of the second leg portion of the second clamp member.

13. The clamping mechanism of claim 11, wherein the first clamp member further includes a dovetail section integrally formed with the second leg portion, the dovetail section configured to interface with a scope or other accessory mount configured to be mounted to the firearm barrel using the clamping mechanism; and wherein the dovetail section includes a threaded hole extending from a top surface of the first clamp member into an interior surface of the second leg portion of the first clamp member for receiving a fastener used to attach the accessory.

14. The clamping mechanism of claim 11, wherein each of the planar inner surfaces of the first and second sets of planar inner surfaces of the first and second clamp members is provided with a protective film to prevent abrasion of the outer surface of the firearm barrel with which it is configured to engage.

15. The clamping mechanism of claim 14, wherein the protective film comprises polyurethane, polytetrafluoroethylene (PTFE), or a rubberized elastomer.

16. In combination: a rifle having a barrel formed with a plurality of outer surfaces each having a convex curvature; and the clamping mechanism of claim 11, wherein the clamping mechanism of claim 11 is configured to be removably secured to a barrel of the rifle such that first and second set of planar inner surfaces of first and second clamp members are disposed in contact with respective outer surfaces of the barrel.

17. The combination of claim 16, wherein the rifle comprises a lever-action, tubular magazine rifle.

* * * * *